United States Patent [19]

Uyeda

[11] Patent Number: 4,512,165

[45] Date of Patent: Apr. 23, 1985

[54] HIGH SECURITY PADLOCK

[75] Inventor: Tim M. Uyeda, South San Gabriel, Calif.

[73] Assignee: La Gard, Inc., Torrance, Calif.

[21] Appl. No.: 364,420

[22] Filed: Apr. 1, 1982

Related U.S. Application Data

[63] Continuation of Ser. No. 177,251, Aug. 11, 1980, abandoned.

[51] Int. Cl.[3] ..... E05B 63/00; E05B 67/36

[52] U.S. Cl. ..... 70/32; 70/1.5; 70/417

[58] Field of Search ..... 70/1, 1.5, 1.7, 32, 70/33, 34, 333, 369, 417, 419, 422; 109/30

[56] References Cited

U.S. PATENT DOCUMENTS

| | | | |
|---|---|---|---|
| 206,327 | 7/1878 | Hillebrand | 70/39 |
| 1,579,632 | 4/1926 | Best . | |
| 2,409,424 | 10/1946 | Falk . | |
| 3,111,022 | 11/1963 | Maynard | 70/1.5 |
| 3,422,643 | 1/1969 | Foote | 70/38 B |
| 3,626,729 | 12/1971 | Fane | 70/38 A |
| 3,769,821 | 11/1973 | Randel | 70/33 |
| 3,820,360 | 6/1974 | Best | 70/32 |
| 3,855,826 | 12/1974 | Hori | 70/38 A |
| 3,996,774 | 12/1976 | Best | 70/32 |
| 4,112,715 | 9/1978 | Uyeda | 70/38 A |
| 4,222,251 | 9/1980 | Uyeda | 70/1.5 |

FOREIGN PATENT DOCUMENTS

| | | | |
|---|---|---|---|
| 1328 | of 1909 | United Kingdom | 70/23 |

*Primary Examiner*—Robert L. Wolfe

*Attorney, Agent, or Firm*—Poms, Smith, Lande and Rose

[57] ABSTRACT

High security lock assembly adapted for locking two flanges together. The lock assembly includes a lock body having flange retaining walls which define a flange receiving opening. A latch bolt is provided which is slidably mounted transverse of the flange receiving opening for locking to the flanges when they are disposed within the flange receiving opening. A removable shield is provided for removably attaching to the lock body for covering the flange receiving opening thereby preventing external access to the latch bolt when the lock assembly is locked to the flanges. The lock assembly further includes a lock cylinder and associated lock cylinder housing wherein the lock cylinder housing cannot be removed from the lock body except upon special key actuated release. An acid actuated relock mechanism is also provided for blocking movement of the latch bolt when acid is applied in attempts to overcome the lock assembly.

21 Claims, 21 Drawing Figures

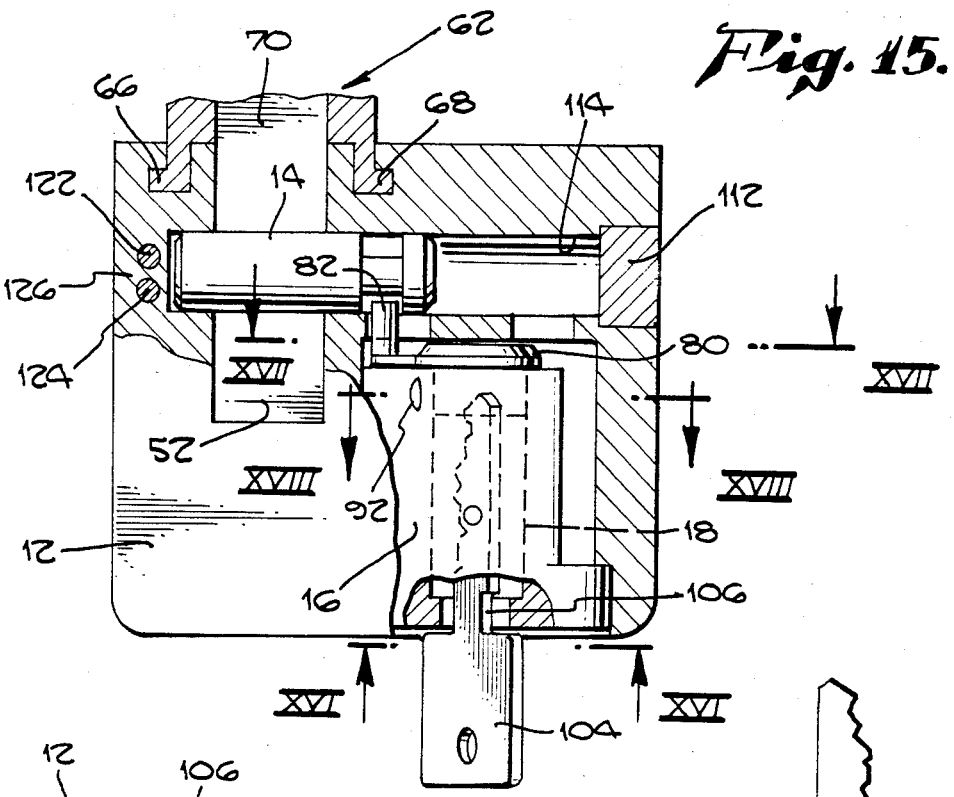
Fig. 15.
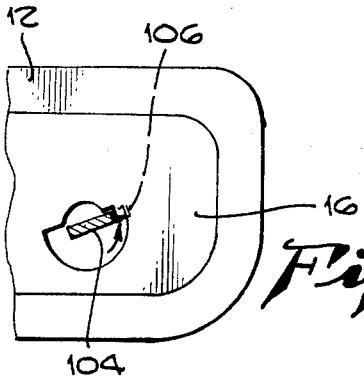
Fig. 16.
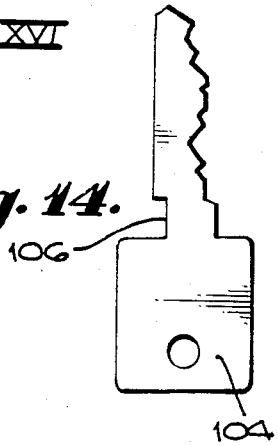
Fig. 14.
Fig. 17.
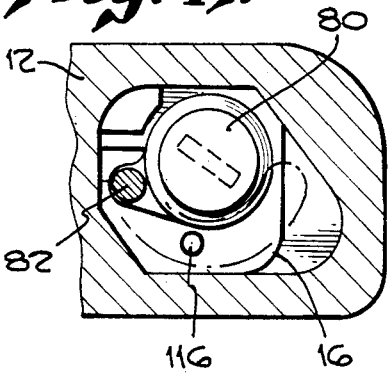
Fig. 18.
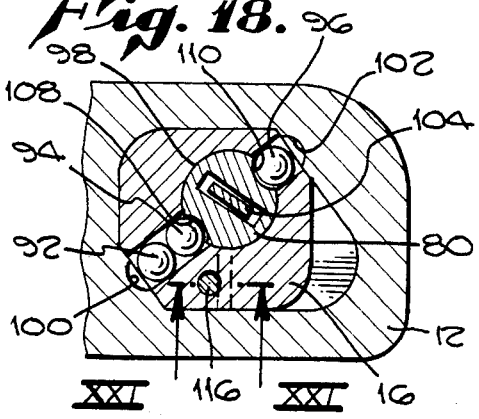

Fig. 19.
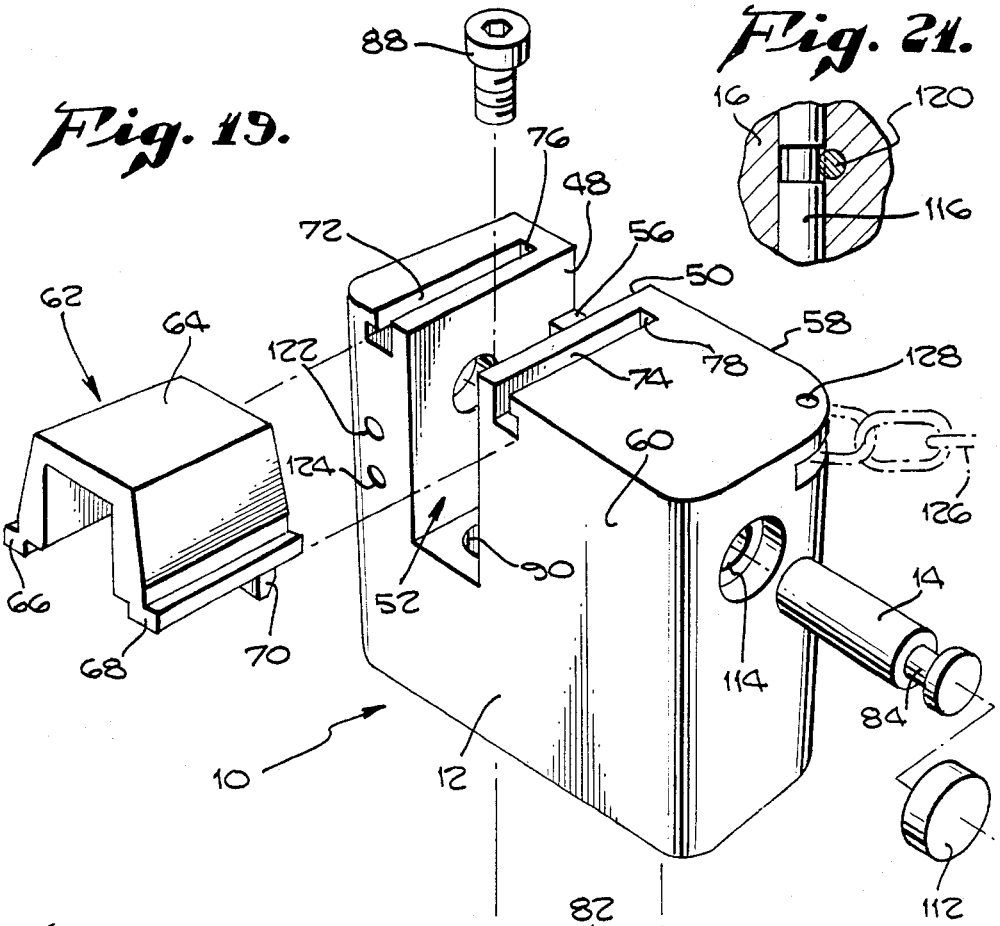
Fig. 21.
Fig. 20.
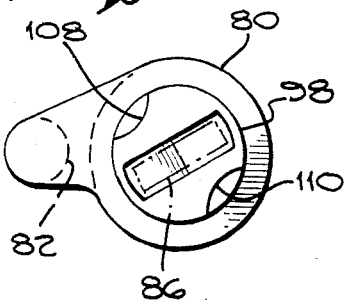
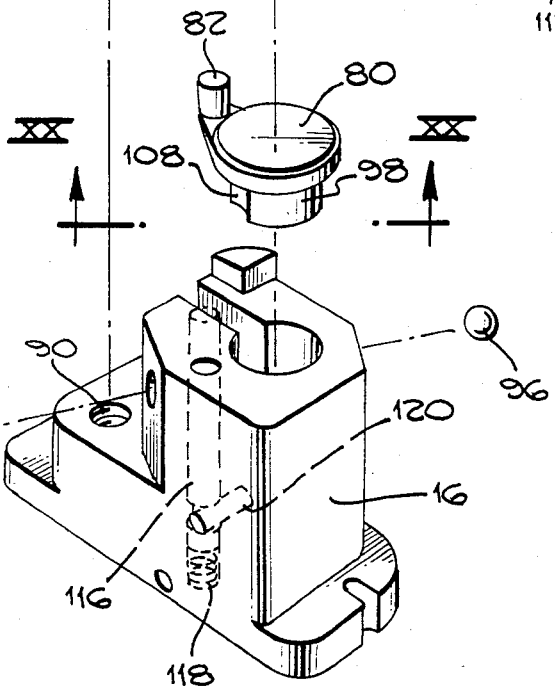

HIGH SECURITY PADLOCK

This is a continuation of application Ser. No. 177,251, filed Aug. 11, 1980, now abandoned.

BACKGROUND OF THE INVENTION

The present invention relates generally to high security padlocks. More specifically, the present invention relates to high security padlocks used in locking two hasps or flanges together.

It is often desirable to lock two structures, such as two sliding vault doors together. For many situations, the use of a simple padlock having a shackle which is locked to adjacent hasps or flanges on the vault doors may be suitable for preventing opening of the vault doors; however, with the present availability of high power hydraulic and mechanical prying equipment in addition to the increased sophistication of criminals, this type of simple padlock proves many times inadequate and is not able to prevent prying open of vault doors.

As a result of the need to provide a suitable padlock for securely holding sliding vault doors or the like closed, there has been developed a typical padlock configuration which is especially useful for hold sliding doors or other surfaces together even when large prying or opening forces are applied to the doors.

In general, lock assemblies have now been developed in which the lock body itself holds the two sliding doors together. The lock body is made of stainless steel and includes retaining surfaces which define a U-shaped opening for receiving hasps or flanges mounted on the sliding vault doors. When the vault doors are closed, the flanges are typically adjacent each other. By placing the lock body on the flanges, the retaining arms are moved into place to prevent opening of the vault doors. In this manner, a lock body made of stainless steel and having heavy weight construction is utilized to provide a much stronger lock to prevent vault door opening.

In order to prevent the lock body from being removed from its retaining position about the flanges, a latch bolt or other similar locking mechanism is utilized to attach the lock body securily to the flanges to prevent removal.

Even though this type of high strength lock assembly serves its purpose to prevent prying open of vault doors or other support structures, the increasing sophistication of criminals has resulted in the need for providing tamper proof features to the above-described lock configuration. For example, since the latch bolt which holds the lock body in place on the flanges is typically weaker than the flange retaining arms, a common practice is to saw through, drill or otherwise destroy the latch bolt to allow removal of the lock body from the flanges. It would therefore be desirable to provide the above-described padlock device with some type of shield to prevent external access to the latch bolt.

Another method used by criminals for tampering with high security locks involves the use of acids. Usually, the locking or stress elements of a lock are made from hard strong materials, such as stainless steel. Although stainless steel is subject to attack and corrosion by many acids, stainless steel is generally much more acid resistant than copper alloys, such as brass and bronze which are commonly used for lock cylinders. Therefore, acids are being used increasingly to attack the non-acid resistant lock cylinder. Once the lock cylinder has been destroyed by chemical action, the latch bolt can then be manipulated away from its engagement with the flanges to allow removal of the lock body from its old retaining position about the flanges. It is therefore apparent that there is a present need to provide a safety relock mechanism to lock the latchbolt in its locked position upon attack and destruction of the lock cylinder by acid.

A further area in which criminals have successfully tampered with padlocks involves the removal of the lock cylinder entirely from the lock body. Typically, the lock cylinder is held in place within the lock body by a lock cylinder housing. The lock cylinder housing is fastened to the lock body in such a way that unfastening of the screws or bolts can only be accomplished when internal access is gained to the lock body. This problem is especially important in the above-described retaining type padlocks because access to the fastening screw or bolt is typically provided by way of the flange receiving opening. Therefore, if the flange receiving opening is inadequately covered or if access is otherwise gained to the flange receiving opening, the lock cylinder housing and lock cylinder would be easily removable. It would be desirable to provide some type of key acutated locking mechanim to lock the lock cylinder housing in place, regardless of other fastening means used, to prevent removal of the lock cylinder accept upon the specific keyed actuation.

SUMMARY OF THE INVENTION

Accordingly, it is an object of the present invention to disclose and provide a lock assembly which is sufficiently strong to secure sliding vault doors or the like together while at the same time providing tamper proof features.

It is another object of the present invention to disclose and provide a high security lock assembly having an acid actuated relock mechanism to reduce the susceptibility of the lock to attack by acid.

A further object of the present invention is to disclose and provide a high security lock assembly in which the lock cylinder can only be removed upon keyed actuation utilizing a special key.

A final object of the present invention is to disclose and provide a lock assembly wherein external access to the latch bolt is prevented by a shield which is not removable when the lock assembly is locked on vault doors or the like, but which can be removed when the lock assembly is unlocked.

The above objects and others are accomplished in accordance with the present invention by the provision of a high security lock assembly which is adapted to lock two flanges together. The high security lock assembly includes a lock body having flange retaining walls which define a flange receiving opening. A latch bolt is provided which is slidably mounted transverse of the flange receiving opening for locking to the flanges when they are disposed within the flange receiving opening. In accordance with the present invention, a removable shield is provided for removably attaching to the lock body for covering the flange receiving opening thereby preventing external access to the latch bolt when the lock assembly is locked to the flanges. The removable shield can be attached and removed from the lock body only when the lock body is not locked to the flanges.

In another aspect of the present invention, the lock assembly, which includes a lock cylinder and associated lock cylinder housing, is provided with housing lock means for locking the lock cylinder housing within the lock body except upon special key actuated release. This feature of the present invention prevents removal of and tampering with the lock cylinder by anyone not having the special key.

In a final aspect of the present invention, an acid actuated relock mechanism is provided wherein the lock cylinder is a relatively non-acid resistant material while the lock body, latch bolt and lock cylinder housing are all relatively acid resistant materials. The relock mechanism includes an acid resistant relock bar which is slidably movable between a latch bolt engaged and a latch bolt disengaged position. Further, the relock bar is biased towards the latch bolt engaged position. A relatively acid non-resistant retaining pin is provided for preventing movement of the relock bar to the latch bolt engaged position except upon application of acid to the retaining pin whereby the retaining pin is structurally weakened.

The improved lock assembly, as summarized above, provides an improved lock where external tampering with the latch bolt is prevented, possible unwanted tampering with the lock cylinder is prevented and an acid actuated safety relock is provided to insure secure locking even during acid attack upon the lock assembly.

These and many other features and attendant advantages of the present invention will become apparent as the invention becomes better understood by reference to the following detailed description when considered in conjunction with the accompanying drawings.

BRIEF DESCRIPTION OF THE DRAWINGS

FIG. 14 shows a preferred special key for special key actuation of the lock cylinder during removal of the lock cylinder and associated housing from the lock body.

FIG. 15 is a partial cut-away section view of the preferred lock assembly of the present invention showing the release position during release and removal of the lock cylinder housing from the lock body.

FIG. 16 is a view of FIG. 15 taken in the XVI—XVI plane.

FIG. 17 is a partial sectional view of FIG. 15 taken in the XVII—XVII plane.

FIG. 18 is another partial sectional view of FIG. 15 which is taken in the XVIII—XVIII plane.

FIG. 19 is an exploded view of the preferred lock assembly of the present invention.

FIG. 20 is a view of the cam member taken in the XX—XX plane of FIG. 19.

FIG. 21 is a partial detailed sectional view of FIG. 19.

DETAILED DESCRIPTION OF A PREFERRED EXEMPLARY EMBODIMENT

The preferred exemplary embodiment of a lock assembly in accordance with the present invention is shown generally at 10 in FIG. 19. Basically, the lock assembly 10 includes a lock body 12, a latch bolt 14 and a lock cylinder housing 16 which houses a lock cylinder as best shown at 18 in FIGS. 2, 9 and 15.

Figure 1:
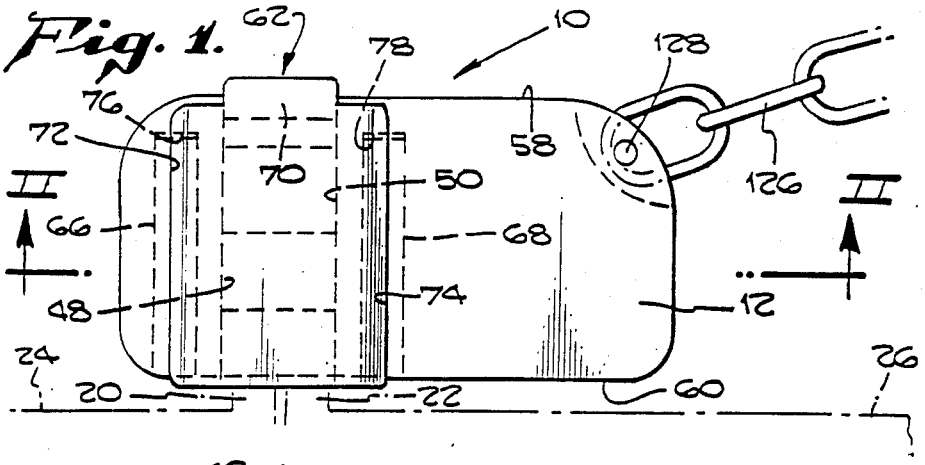
FIG. 1 is a top view of the preferred lock assembly showing it locked to flanges secured to a support structure.
Figure 2:
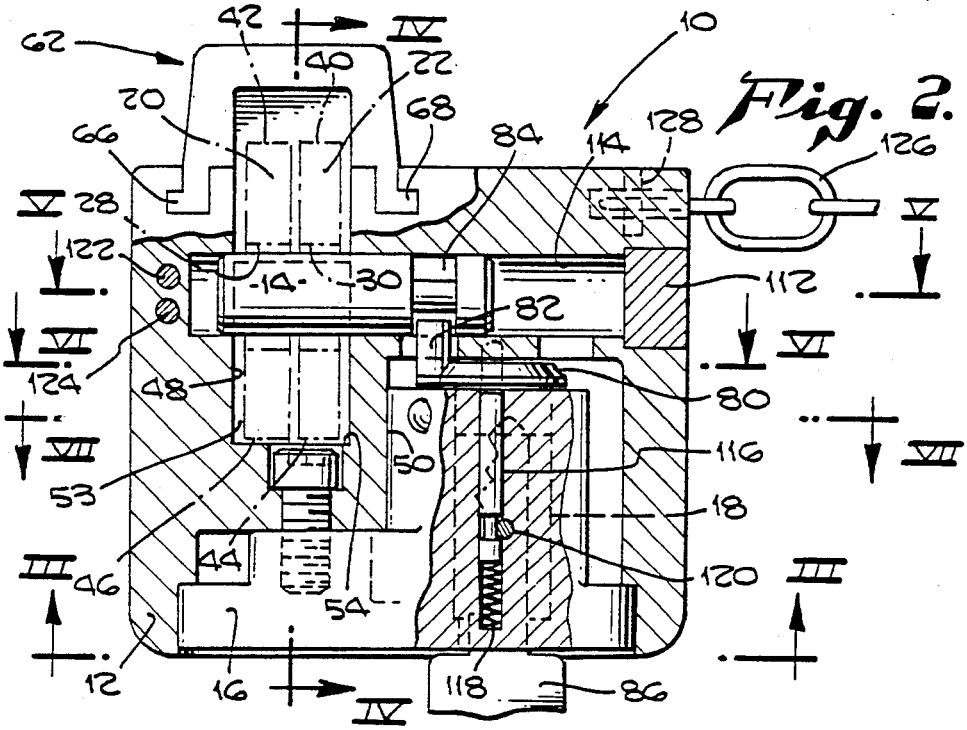
FIG. 2 is a cross-sectional view of FIG. 1 taken in the II—II plane.
Figure 3:
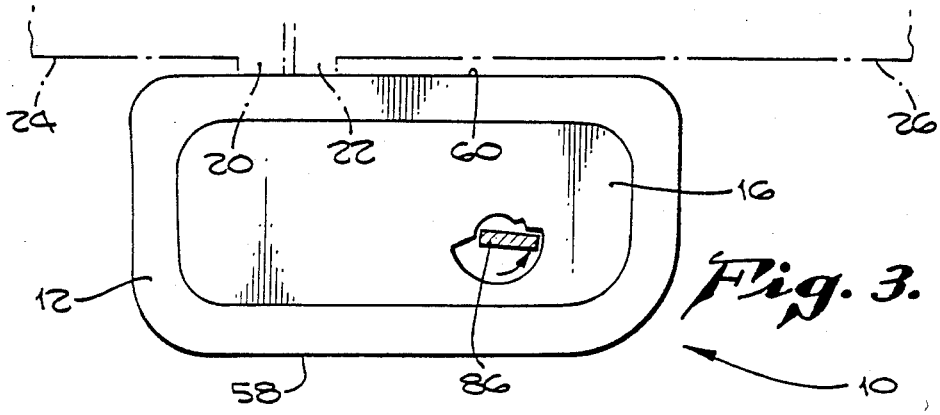
FIG. 3 is a view of FIG. 2 taken in the III—III plane.
Figure 4:
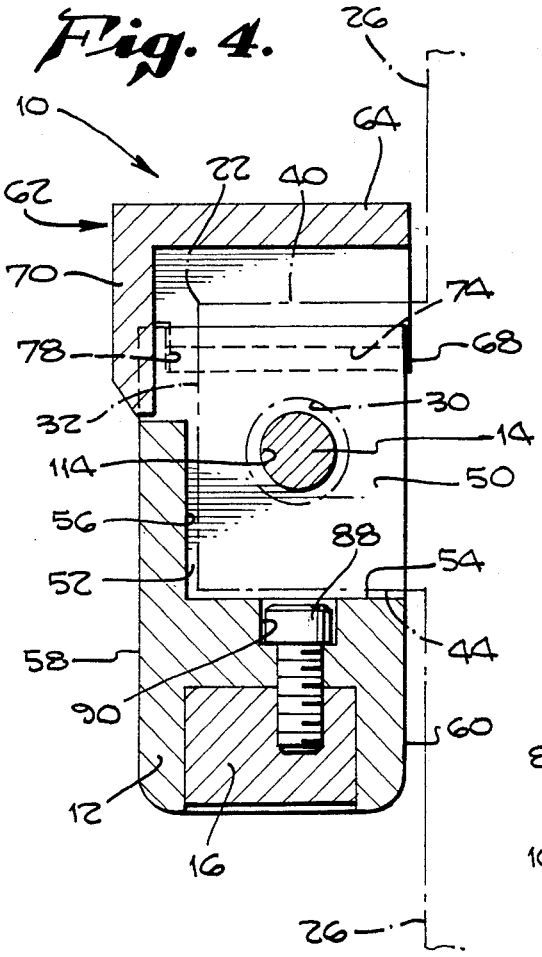
FIG. 4 is a cross-sectional view of FIG. 2 taken in the IV—IV plane.
Figure 5:
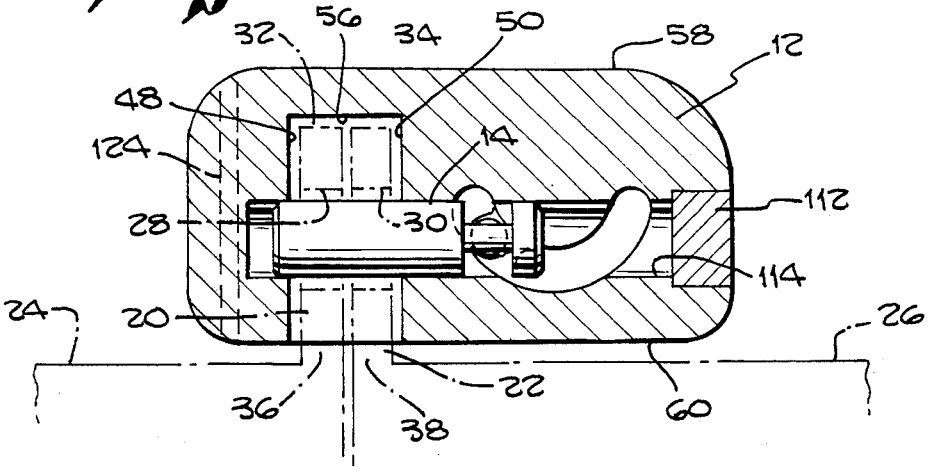
FIG. 5 is a cross-sectional view of FIG. 2 taken in the V—V plane.

The lock assembly 10 is designed and adapted for locking two flanges together. Typically, these flanges, such as flanges 20 and 22 in FIG. 1 are secured to support structures such as vault doors 24 and 26. The vault doors 24 and 26 with the flanges 20 and 22 secured thereon by welding, bolts or other suitable means, are slidable between an open position to allow entry into a vault and a closed position where flanges 20 and 22 are adjacent each other. The flanges, as best shown in FIGS. 2, 4 and 5, have bolt holes 28 and 30 which are positioned for axial alignment when the flanges 20 and 22 are moved adjacent each other. The flanges 20 and 22 have outer edges 32 and 34, inner portions 36 and 38 next to the vault doors 24 and 26, upper edges 40 and 42 and lower edges 44 and 46.

The lock body 12 includes flange-retaining walls 48 and 50 which define a flange receiving opening 52. The lock body 12 further includes a bottom seating wall 54 for contacting the flange lower edges 44 and 46 to provide vertical alignment of the locked body 12 on the flanges 20 and 22. In addition, front seating wall 56 is provided for contacting and positioning the flanges 20 and 22 horizontally within the flange receiving opening 52. The lock body also has a front 58 and a back 60. When flanges 20 and 22 are adjacent each other for locking, the lock assembly 10 is placed onto flanges 20 and 22 with front seating wall 56 and bottom seating wall 54 helping to position the flanges within the flange receiving opening 52 to allow insertion of latch bolt 14 into and through bolt holes 28 and 30. In this manner, the retaining walls 48 and 50 keep the flanges 20 and 22 from being pulled apart while the latch bolt 14, by way of its engagement with bolt holes 28 and 30, prevents the lock assembly 10 from being removed from the flanges 20 and 22.

A common technique in overcoming the locking action of lock assembly 10 on flanges 20 and 22 involves sawing through or otherwise tampering with latch bolt 14 in order to remove the lock body 12 from its retaining position about flanges 20 and 22. As will be realized, when the lock assembly 10 is locked in place on flanges 20 and 22, the lock body back 60 is flush against vault doors 24 and 26 thereby preventing access to the latch bolt 14 from the rear. Further, the bottom seating wall 54 and front seating wall 56 prevent external access to the latch bolt from the bottom or front of the lock body. However, the latch bolt 14 may still be attacked from the top of lock body 12.

In accordance with the present invention, removable shield means are provided for preventing access to the flange receiving opening 52 and latch bolt 14. The removable shield means is provided by a removable shield plate shown generally at 62. The shield plate 62 includes a U-shaped shielding portion 64 and integral mating portions 66 and 68. Although the shielding portion 64 is shown in a U-shape, the particular configuration of the shielding portion is not important so long as it provides adequate clearance for allowing insertion of flanges 20 and 22 within flange receiving opening 52 for engagement with lock assembly 10. The shield plate 62 also includes front security wall 70. The shield plate 62 is removably mounted onto lock body 12 by way of channels 72 and 74 which are disposed in the top of the lock body 10 and extend alongside the flange receiving opening 52 (see FIG. 19). The channels 72 and 74 are shaped to matingly receive mating portions 66 and 68 respectively. The channels 72 and 74 open onto the lock body back 60, but are terminated by channel ends 76 and 78 respectively prior to reaching the lock body front 58. This provides for insertion of shield plate 62 into its mounted position only from the rear of lock body 12. As will be realized, when the lock body is locked in place on flanges 20 and 22, the shield plate 62 cannot be removed unless the lock body 12 is moved sufficiently away from bolt doors 24 and 26 to allow slidable removal of shield plate 62 from channels 72 and 74. Accordingly, shield plate 62 can only be attached and removed from lock body 12 when the lock body 12 is removed from engagement with flanges 20 and 22.

Figure 8:
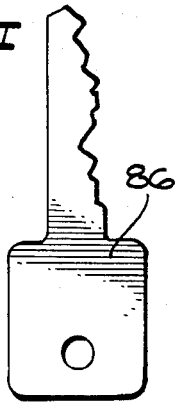
FIG. 8 shows a regular key used for regular keyed actuation of the lock cylinder assembly.
Figure 11:
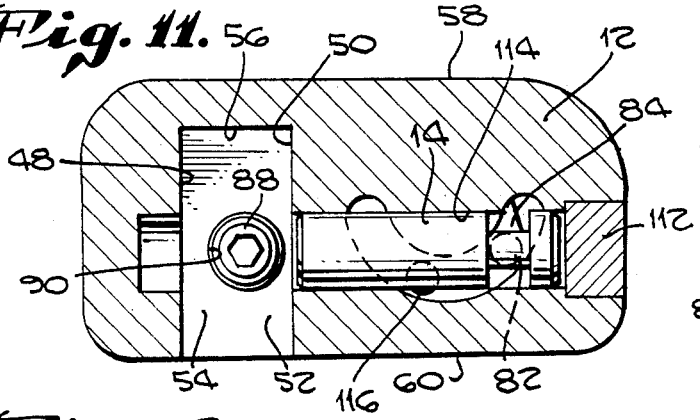
FIG. 11 is a cross-sectional view of FIG. 9 taken in the XI—XI plane.
Figure 10:
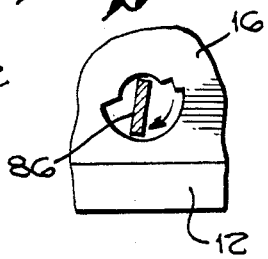
FIG. 10 is a view of FIG. 9 taken in the X—X plane.
Figure 12:
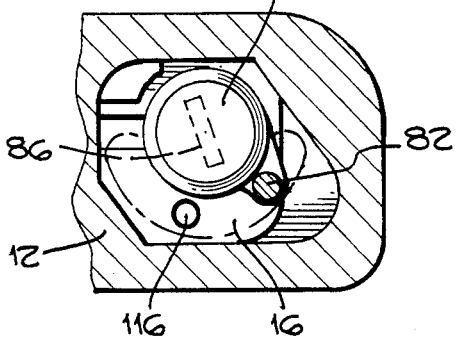
FIG. 12 is a partial sectional view of FIG. 9 taken in the XII—XII plane.

In order to operate the latch bolt 14 between a bolt hole engaged position (FIG. 1) and a bolt hole disengaged position (FIG. 9), a lock cylinder 18 and associated lock cylinder housing 16 are provided. The lock cylinder 18 is removably secured within lock cylinder housing 16 and can only be removed when lock cylinder housing 16 is first removed from the lock body. The lock cylinder 18 is connected to cam member 80. The cam member 80 includes a cam arm 82 which operably contacts the latch bolt 14 by way of groove 84 to slidably move the latch bolt 14 between bolt hole engaged and disengaged positions. Rotation of cam member 80 is normally accomplished by keyed actuation of lock cylinder 18 utilizing a key, such as regular key 86 shown in FIG. 8.

Fastening means such as bolt 88 and corresponding bolt hole 90 are provided for securing lock cylinder housing 16 within lock body 12. As will be noted, bolt 88 (when securing lock cylinder housing 16) is associated with the bottom wall 54 of the flange receiving opening 52. This prevents removal of bolt 88 from lock body 12 when the lock body is locked to flanges 20 and 22 and shield plate 62 is in place.

Figure 7:
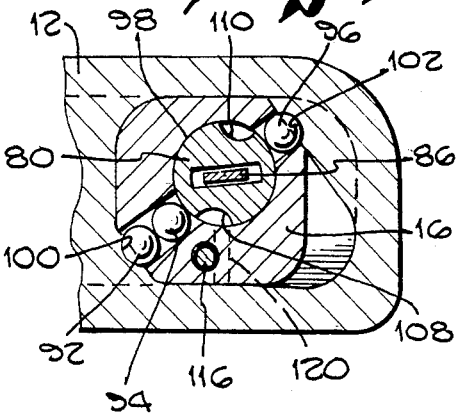
FIG. 7 is another partial cross-sectional view of FIG. 2 which is taken in the VII—VII plane.
Figure 13:
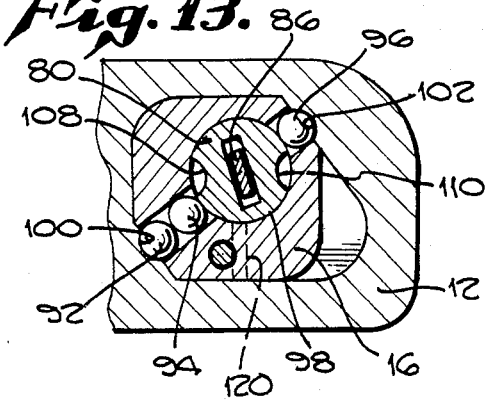
FIG. 13 is another partial sectional view of FIG. 9 which is taken in the XIII—XIII plane.

In addition to bolt 88 and bolt hole 90, the present invention particularly contemplates the inclusion of housing lock means for locking the lock cylinder housing 16 within the lock body 12, except upon keyed actuation release. As best shown in FIGS. 7 and 13, housing lock means as particularly contemplated by the present invention is provided by balls 92, 94 and 96 which are mounted within lock cylinder housing 16. During normal operation of cam member 80 between the positions shown in FIG. 7 and FIG. 13, the balls are forced outward by their contact with cam member rim 98 into engagement with mating dimples 98 and 100 in lock body 12. During normal or regular keyed actuation of cam member 80, the balls 92 and 96 remain biased into engagement with dimples 100 and 102. In this way, even though bolt 88 is removed from its securing position, the lock cylinder housing 16 will still remain secured to the lock body 12. Ball 94 is provided as a spacer between cam member rim 98 and ball 92. Any other type of suitable spacer could be utilized in place of ball 94; however, in the present invention, the use of ball 94 is preferred.

Figure 9:
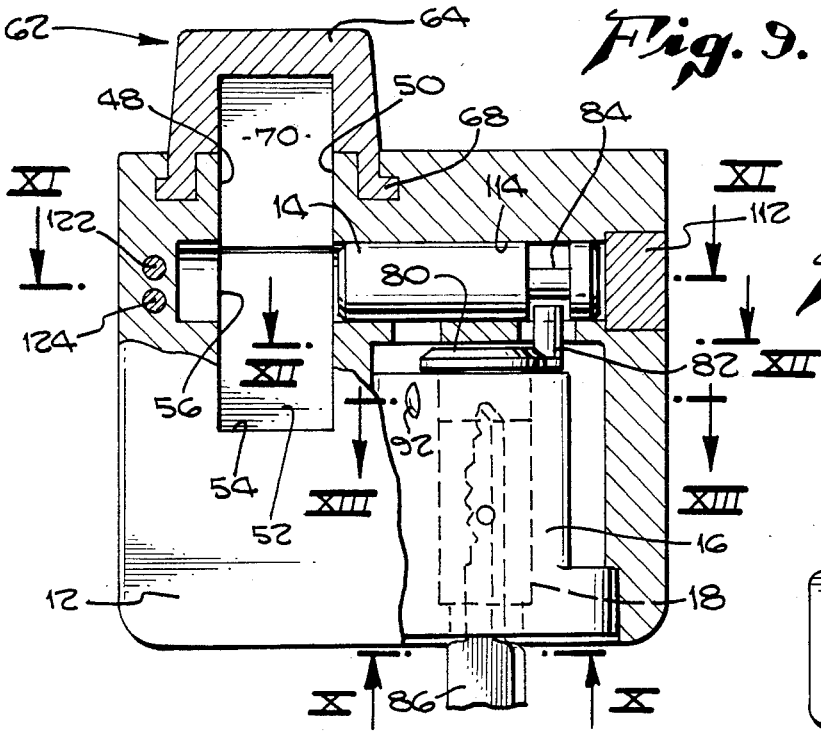
FIG. 9 is a partial cut-away section view of the preferred lock assembly of the present invention showing the latch bolt in the bolt hole disengaged position.

In order to release balls 92 and 96 from their engaged position with dimples 100 and 102, a special key such as that shown in FIG. 14 at 104 is provided. Special key 104 is identical to regular key 86 except that indentation 106 is provided. The indentation 106 in special key 104 allows the cam member 80 to be turned as shown in FIGS. 15, 16, 17 and as best shown in FIG. 18. In FIG. 18, the cam member 80 is shown in the release position where balls 94 and 96 are aligned with notches 108 and 110 in cam member 80. In this release position, the balls 94 and 96 are allowed to move into notches 108 and 110 thereby moving balls 92 and 96 from their engaged position with dimples 100 and 102. With balls 92 and 96 removed from their engagement with dimples 100 and 102, the lock cylinder housing 16 may then be removed from lock body 12 provided bolt 88 is also removed. This special key actuator release feature of the present invention allows normal or regular operation of the bolt (utilizing key 86) to the normal bolt hole engaged position as shown in FIG. 2 and to the normal bolt hole disengaged position as shown in FIG. 9. Further, a special key 104 is available to selected individuals only, which provides for actuation of the lock cylinder 18 and associated cam member 80 to the position shown in FIG. 15 which provides for removal of the lock cylinder housing providing of course that bolt 88 is also removed. As will be realized, this safety release feature of the present invention, prevents anyone having only a suitable wrench from removing and/or changing lock cylinders for a given lock while at the same time providing a key actuated method which allows only those individuals with a special key to remove the lock cylinder housing 16. The special key 104 can also be used for normal operations in locking and unlocking the lock assembly 10.

To provide a lock assembly of suitable strength, the lock body 12 is made from a suitable steel based alloy to provide a hard yet not brittle lock body 12. Preferably, stainless steel is utilized for its inherent strength and also for esthetic reasons. In addition, the shield plate 62 and latch bolt 14 should also be of a suitable steel based alloy, such as stainless steel. Further, the plug 112 which prevents removal of latch bolt 14 from latch bolt bore 114 should also be a suitably strong steel alloy such as stainless steel. With regards to the lock cylinder housing 16, it too is also made from a suitably strong steel alloy such as stainless steel. The lock cylinder 18, however, is typically made from a soft metal such as copper based alloys, particularly brass or bronze. The use of soft metals is required to insure prolonged smooth operation of lock cylinder 18. The use of soft metal, such as brass or bronze, for lock cylinders 18 is well known. Equally well known, is the fact that copper based alloys such as brass or bronze are less resistant to certain acids than stainless steel. As stated in the Background of the Invention, the use of acid to dissolve away the lock cylinder to overcome the lock assembly without significant corrosive action on the lock body and associated acid resistant parts is known and has been used to tamper with lock assemblies.

Figure 6:
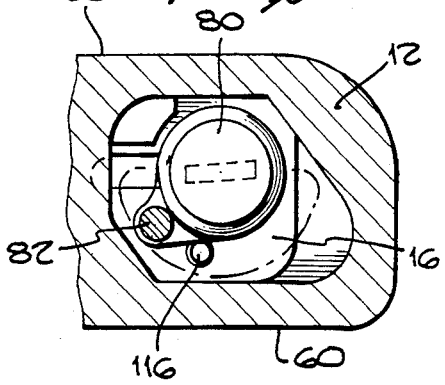
FIG. 6 is a partial cross-sectional view of FIG. 2 taken in the VI—VI plane.

In accordance with the present invention, relock means are provided for engaging lock bolt 14 to prevent slidable movement of the lock bolt even when the lock cylinder 16 has been dissolved or otherwise corroded or weakened by acid. The relock means includes an acid resistant relock bar 116 as best shown in FIG. 2. Bias means such as bias spring 118 is provided below the relock bar 116 for applying continual upward bias on the relock bar. Retaining pin means such as retaining pin 120 is provided to prevent relock bar 116 from being thrust upward by bias spring 118 during normal lock operation. The retaining pin 120 is preferably a soft metal having the same composition as lock cylinder 18, such as bronze or brass. During application of a given acid, such as hydrochloric acid or nitric acid which are corrisive acids commonly used to used to attack locks, to the lock assembly 10, the retaining pin 120 will be attacked and destroyed during destruction of the lock cylinder 18. Once the retaining pin 120 is destroyed, the relock bar 116 is thrust by bias spring 118 upward to block rotation of cam member 80. As best shown in FIG. 6, the relock bar 116 when thrust upward prevents counterclockwise rotation of cam member 80 to thereby prevent disengagement of latch bolt 14 from its locking engagement with flanges 20 and 22. The retaining pin 120 may conveniently be formed as an integral part of the lock cylinder 18 if desired.

As a further tamperproof feature of the present invention, pins 122 and 124 are provided in lock body 12 to prevent someone from drilling a hole through the lock body at 126 as shown in FIG. 15 to gain access to the tip of latch bolt 14. The pins 122 and 124 are made of an extremely hard material, such as carbide steel or similar extremely hard metal.

In actual use, the vault doors 24 and 26 may be left open as often as they are left closed. Therefore, it is desirable to keep the lock assembly 10 at a convenient location for locking to the flanges 20 and 22 when the vault doors 24 and 26 are closed. In accordance with the present invention, a chain 126 is provided which is attached to pin 128. The pin 128 is in turn secured to lock body 12. The other end of chain 126 is attached to one of the vault doors 24 or 26 at a location where the lock assembly 10 can be readily picked up and locked to flanges 20 and 22 when desired.

Having thus described an exemplary embodiment of the present invention, it should be noted by those skilled in the art that the within disclosures are exemplary only and that various other alternatives, adaptations and modifications may be made within the scope of the present invention. Accordingly, the present invention is not limited to the specific embodiments as illustrated herein.

What is claimed is:

1. In a lock assembly adapted for locking two flanges together, where the flanges are secured to support structures and movable to a position adjacent each other, said flanges further including bolt holes positioned for axial alignment when said flanges are in said adjacent position, said lock assembly including a lock body having flange retaining walls defining a flange receiving opening for receiving and holding said flanges in said adjacent position, said lock assembly further including a latch bolt for engaging said flange bolt holes when the flanges are within said flange receiving opening, to lock said lock assembly to said flanges, the improvement in said lock assembly comprising:

removable shield means removably attached to said lock body for covering said flange receiving opening to thereby prevent external access to said latch bolt when said lock assembly is locked to the flanges, said shield means being removable from said lock body only when the retaining walls are removed from retaining contact with said flanges.

2. In an improved lock assembly according to claim 1 wherein said flanges have an outer edge away from said support structure, an inner portion next to the support structure, an upper edge and a lower edge, and said lock body has a front and a back whereby the back of the lock body is closest to said support structure when the lock assembly is locked to the flanges, said lock body further including a bottom seating wall for contacting said flange lower edge and a front seating wall for contacting said flange outer edge, said seating walls further defining said flange receiving opening and providing for positioning of said bolt holes for engagement by said latch bolt, wherein the improvement comprising said shield means includes a removable shield plate for covering the upper edge of said flanges and the top of said flange receiving opening whereby external access to said latch bolt is prevented from the bottom and front by said seating walls, from the back by said support structure and flange inner portion and from the top by said shield plate.

3. An improved lock assembly according to claim 2 wherein said shield means includes channels disposed in the top of said lock body and extending alongside said flange receiving opening, said channels extending from the back of said lock body and terminating rearward of the lock body front, and said shield plate further including integral mating portions for slidably entering said channels from the rear of said lock body, whereby rearward movement of the mating portions of said shield plate is blocked by said support structure when the lock assembly is locked to said flanges thereby prevent removal of said sheld plate from the lock body.

4. An improved lock assembly according to claim 3 wherein said channels have a greater width at the bottom than at the top.

5. In an improved lock assembly according to claim 1 wherein said lock assembly includes a lock cylinder and associated lock cylinder housing insertable within said lock body for actuating said latch bolt between bolt hole engaged and disengaged positions, said lock cylinder being made from a relatively non-corrosive acid resistant material while the lock body, latch bolt and lock cylinder housing consist of relatively corrosive acid resistant material, the further improvement including relock means for engaging said lock bolt to prevent slidable movement of said lock bolt upon application of corrosive acid to said lock cylinder.

6. An improved lock assembly according to claim 5 wherein said relock means includes:

a corrosive acid resistant relock bar slidably movable between lock bolt engaged and disengaged positions;

bias means for biasing said relock bar towards said lock bolt engaged position; and retaining pin means made from a relatively non-corrosive acid resistant material for retaining said relock bar in said disengaged position except upon application of corrosive acid to said retaining pin.

7. In an improved lock assembly according to claim 1 wherein said lock cylinder housing is secured to said lock body by fastening means associated with the bottom wall of said flange receiving opening, said fastening means being accessible only from within said flange receiving opening when said lock cylinder housing is secured within said lock body, the further improvement including housing lock means for locking said lock cylinder housing within said lock body except upon keyed actuation release.

8. An improved lock assembly according to claim 7 wherein said lock cylinder includes a cam member having a cam arm for operably contacting said latch bolt, said cam member being normally rotatable by regular keyed actuation between locked and unlocked positions, said housing lock means including means for securing said lock cylinder housing to said lock body while said cam member is in and between locked and unlocked positions and special key actuation means for operating said cam member to a release position whereby said lock cylinder housing is no longer secured to said lock body by said securing means.

9. An improved lock assembly according to claim 8 wherein said means for securing said lock cylinder housing to said lock body includes balls mounted in said housing for contacting a ball contact rim on said cam member whereby said contact seats the balls in locking engagement with mating dimples in said lock body, said cam rim further including notches positioned for alignment with said balls when said cam is moved to the release position to release said balls from their mating engagement with said mating dimples.

10. An improved lock assembly according to claim 9 further including means for hanging said lock assembly near said flanges when they are adjacent each other.

11. In a lock assembly having a lock body with a receiving opening for receiving one or more flanges, a lock bolt chamber located transversely of said flange receiving opening, said lock bolt chamber having a lock bolt slidably mounted therein for reversable entry into said flange receiving opening for engaging said flanges and a lock cylinder for providing keyed actuation of said lock bolt into and out of said flange receiving opening, wherein said lock body and lock bolt are made from a relatively corrosive acid resistant material and said lock cylinder is made from a relatively non-corrosive acid resistant material, the improvement comprising:

relock means for engaging said lock bolt to prevent slidable movement of said lock bolt upon application of corrosive acid to said lock cylinder.

12. An improved lock assembly according to claim 11 wherein said relock means includes:

a corrosive acid resistant relock bar slidably movable between lock bolt engaged and disengaged positions;

bias means for biasing said relock bar towards said lock bolt engaged position; and retaining pin means made from a relatively non-corrosive acid resistant material for retaining said relock bar in said disengaged position except upon application of corrosive acid to said retaining pin.

13. An improved lock assembly according to claim 12 wherein said corrosive acid resistant material is a steel based alloy and said non-corrosive acid resistant material is a copper based alloy.

14. An improved lock assembly according to claim 13 wherein said steel based alloy is stainless steel and said copper based alloy is brass.

15. An improved lock assembly according to claim 14 wherein said retaining pin means is integral with said lock cylinder.

16. A corrosive acid responsive relock mechanism adapted for relocking a latch bolt associated with a corrosive acid resistant lock, said lock having a non-corrosive acid resistant lock cylinder for locking and unlocking said latch bolt, said relock mechanism comprising:

a corrosive acid resistant relock bar for engaging and locking said latch bolt;

spring means for biasing the relock bar into engagement with said latch bolt; and a non-corrosive acid resistant retaining pin preventing said relock bar from engaging said latch bolt except upon application of acid to said lock whereby said retaining pin is chemically attacked and structurally weakened to allow spring biasing of said relock bar into engagement with the latch bolt.

17. A high security lock assembly adapted to lock two flanges together comprising:

a lock body having flange retaining walls defining a flange receiving opening;

a latch bolt slidably mounted transverse of said flange receiving opening for locking to said flanges when they are disposed within said flange receiving opening; and removable shield means removably attached to said lock body for covering said flange receiving opening thereby preventing external access to said latch bolt when said lock assembly is locked to said flanges.

18. A high security lock assembly according to claim 17 wherein said lock assembly includes a lock cylinder and associated lock cylinder housing insertable within said lock body for actuating said latch bolt between flange engaged and flange disengaged positions;

housing lock means for locking said lock cylinder housing within said lock body except upon key actuated release.

19. A high security lock assembly according to claim 18 wherein said lock cylinder is a relatively non-corrosive acid resistant material while the lock body, latch bolt and lock cylinder housing are all relatively corrosive acid resistant materials, said lock assembly further including relock means for engaging said lock bolt to prevent slidable movement of said lock bolt upon application of acid to said lock cylinder.

20. A high security lock assembly adapted to lock two flanges together comprising:

a lock body having flange retaining walls defining a flange receiving opening;

a latch bolt slidably mounted transverse of said flange receiving opening for locking to said flanges when they are disposed within said flange receiving opening;

a lock cylinder and associated lock cylinder housing insertable within said lock body for actuating said latch bolt between flange engaged and flange disengaged positions, said lock cylinder including a cam member having means for operably contacting said latch bolt, said cam member being normally rotatably by regular keyed actuation between locked and unlocked positions; and housing lock means for locking said lock cylinder housing within said lock body except upon key actuated release, said housing lock means including means for securing said lock cylinder housing to said lock body while said cam member is in and between locked and unlocked positions and special key actuation means for operating said cam member to a release position whereby said lock cylinder housing is no longer secured to said lock body by said securing means.

21. A lock assembly according to claim 20 wherein said means for securing said lock cylinder housing to said lock body includes one or more balls mounted in said housing for contacting a ball contact rim on said cam member whereby said contact seats the balls in locking engagement with mating dimples in said lock body, said cam rim further including notches positioned for alignment with said balls when said cam is moved to a release position to release said balls from their mating engagement with said mating dimples.

* * * * *